United States Patent [19]

Saga et al.

[11] Patent Number: 4,761,192

[45] Date of Patent: Aug. 2, 1988

[54] METHOD OF AND APPARATUS FOR REMELTING AND HARDENING A SHAFT

[75] Inventors: Toshihiko Saga; Akitaka Inao; Kenji Fujii, all of Saitama, Japan

[73] Assignee: Honda Giken Kogyo Kabushiki Kaisha, Tokyo, Japan

[21] Appl. No.: 98,769

[22] Filed: Sep. 17, 1987

Related U.S. Application Data

[63] Continuation of Ser. No. 865,643, May 16, 1986, abandoned, which is a continuation of Ser. No. 708,917, Mar. 6, 1985, abandoned.

[30] Foreign Application Priority Data

| | | | |
|---|---|---|---|
| Mar. 7, 1984 | [JP] | Japan | 59-44249 |
| Apr. 6, 1984 | [JP] | Japan | 59-69489 |
| Apr. 9, 1984 | [JP] | Japan | 59-70680 |
| Apr. 9, 1984 | [JP] | Japan | 59-70681 |
| Apr. 27, 1984 | [JP] | Japan | 59-85994 |

[51] Int. Cl.[4] ..... C21D 9/28; C21D 9/30

[52] U.S. Cl. ..... 148/152; 148/902; 148/904; 266/78; 266/261

[58] Field of Search ..... 148/4, 13, 145, 152, 148/146, 150, 151, 903, 902, 901, 904; 266/245, 78, 96, 99, 261

[56] References Cited

U.S. PATENT DOCUMENTS

| | | | |
|---|---|---|---|
| 2,017,305 | 10/1935 | Campbell | 148/904 |
| 2,254,700 | 9/1941 | Jones | 266/99 |
| 3,967,089 | 6/1976 | Seulen et al. | 266/249 |
| 4,147,335 | 4/1979 | Heck | 266/261 |
| 4,249,724 | 2/1981 | Reinke et al. | 266/261 |
| 4,312,685 | 1/1982 | Riedl | 148/152 |

FOREIGN PATENT DOCUMENTS

| | | | |
|---|---|---|---|
| 2703469 | 5/1979 | Fed. Rep. of Germany . | |
| 2825579 | 12/1979 | Fed. Rep. of Germany | 148/4 |
| 3224745 | 7/1983 | Fed. Rep. of Germany . | |
| 8000086 | 1/1980 | Int'l Pat. Institute . | |
| 8201016 | 1/1982 | Int'l Pat. Institute . | |
| 8300051 | 1/1983 | Int'l Pat. Institute . | |
| 534115 | 12/1939 | United Kingdom . | |
| 544165 | 10/1940 | United Kingdom . | |
| 2004613 | 4/1970 | United Kingdom . | |
| 1600824 | 1/1978 | United Kingdom . | |
| 2004919B | 9/1978 | United Kingdom . | |
| 2022146B | 5/1979 | United Kingdom . | |
| 2042594B | 11/1979 | United Kingdom . | |

*Primary Examiner*—L. Dewayne Rutledge
*Assistant Examiner*—S. Kastler
*Attorney, Agent, or Firm*—Armstrong, Nikaido, Marmelstein & Kubovcik

[57] ABSTRACT

A method of and an apparatus for remelting and hardening an elongate workpiece such as a shaft having a plurality of axially spaced shaft portions to be processed. The shaft is held in a second position, heated, and thereafter transferred to a first position close and parallel to the second position. The shaft is then held in the first position, and the outer surface of one of the shaft portions is remelted and hardened with a torch. Thereafter, the torch is moved parallel to the shaft to remelt and harden the adjacent shaft portions successively. An apparatus for carrying out the method includes a device for holding the shaft in the second position, a preheating device for heating the shaft, a device for holding the shaft in the first position, a device for rotating the shaft about its own axis, a torch for remelting and hardening the outer surfaces of the shaft portions, and a torch moving device for moving the torch axially along the shaft successively into facing relation to the outer surfaces of the shaft portions.

12 Claims, 8 Drawing Sheets

METHOD OF AND APPARATUS FOR REMELTING AND HARDENING A SHAFT

This application is a continuation of application Ser. No. 865,643 filed May 16, 1986, now abandoned, which is a continuation of application Ser. No. 708,917 filed Mar. 6, 1985, now abandoned.

BACKGROUND OF THE INVENTION

1. Field of the invention:

The present invention relates to a method of and an apparatus for remelting and hardening a shaft, and more particularly to a method of and an apparatus for remelting and hardening the outer cam profile surfaces of a camshaft.

2. Description of the Prior Art:

There has been practiced a remelting and hardening process for hardening the outer cam profile surfaces of camshafts for use in internal combustion engines. As disclosed in UK Patent Application GB No. 2 004 613 A, the remelting and hardening process includes the step of melting the cam surfaces with a TIG torch or a laser beam, for example, to form hardened cam surfaces.

A camshaft has a plurality of cam surfaces, e.g., at least eight cam surfaces for use in a four-cylinder engine, and twelve cam surfaces for use in a six-cylinder engine. In order to remelt and harden such a plurality of cam surfaces, a conventional apparatus includes a plurality of remelting burners for heating the cam surfaces, respectively, as shown in U.S. Pat. No. 4,147,335. The disclosed apparatus is advantageous in that all of the cam surfaces can be remelted and chilled simultaneously in a single operation. However, the apparatus requires as many burners as there are cam surfaces to be treated, hence is complex in construction, large in size, and costly to manufacture.

To meet the growing demands for lighter and more compact engines, the recent trend of automotive engines is toward smaller pitches between the cams on a cam shaft. As a consequence, the remelting burners are required to be spaced at smaller intervals to meet the pitches between the cam surfaces. Since however each burner has a dimensional limitation due to its required width, it is practically impossible to provide the remelting burners or torches respectively adjacent to the cams for all camshafts.

It is customary to preheat the overall camshaft up to a temperature ranging from 250° C. to 450° C. in the remelting process. The preheating step is necessary because if the cam surfaces were to be remelted and chilled efficiently without being preheated, the remelted portions would be chilled and solidified quickly to cause cracks due to contraction, and oxygen molecules discharged from an oxide in the cast iron would be combined with carbon molecules to produce a gas of carbon dioxide, which would be liable to be trapped in the solidified surfaces, resulting in a porous structure owing to a so-called "cold shut". The above defects can be avoided, when remelting and chilling the cam surfaces without preheating them, by applying an amount of thermal energy equivalent to a preheat to each of the cams, that is, by slowly heating the cams to remelt the same. Such a process is however time-consuming and lowers the rate of production.

It is the conventional practice to preheat the cams in the remelting process by either passing an electric current through the camshaft to heat the same or placing the camshaft in a heating furnace. In any case, the camshaft is preheated in an area different from the remelting area. Additionally, the electric heating is disadvantageous in that it is time-consuming to transfer the preheated camshaft from the preheating area to the remelting area, and the camshaft may be subjected to irregular localized temperatures while it is being carried from the preheating area to the remelting area, the irregular localized temperatures being not preferable for the remelting process. The furnace heating process requires a heating furnace, which increases the space and cost of installation and lowers the efficiency.

SUMMARY OF THE INVENTION

In view of the aforesaid difficulties of the prior art, it is an object of the present invention to provide an apparatus for and a method of effieciently and effectively remelting and hardening a shaft having a plurality of surfaces to be treated, such as cams on a camshaft for use in a multicylinder engine, thus saving an expenditure of labor required in the remelting and hardening process.

Another object of the present invention is to provide an apparatus for and a method of remelting and hardening a shaft in a process including a preheating step with a compact arrangement, the process being carried out in a shortened period of time with an increased thermal efficiency at a reduced cost.

According to the present invention, there is provided a method of remelting and hardening an elongate workpiece having a plurality of axially spaced workpiece portions to be processed, the method comprising the steps of holding the workpiece in a first position, rotating the workpiece about its own axis in the first position, remelting and hardening, with a torch, at least a portion of the outer surface of at least one of the workpiece portions, and moving the torch axially along the workpiece to remelt and harden adjacent ones of the workpiece portions successively.

According to the present invention, there is also provided an apparatus for remelting and hardening an elongate workpiece having a plurality of axially spaced workpiece portions to be processed, the apparatus comprising a holding means for holding the workpiece in a first position, a workpiece rotating means for rotating the workpiece about its own axis in the first position, at least one torch for remelting and hardening at least a portion of each of the outer surfaces of the workpiece portions, and a torch moving means for moving the torch axially along the workpiece successively into facing relation to the outer surfaces of the workpiece portions.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
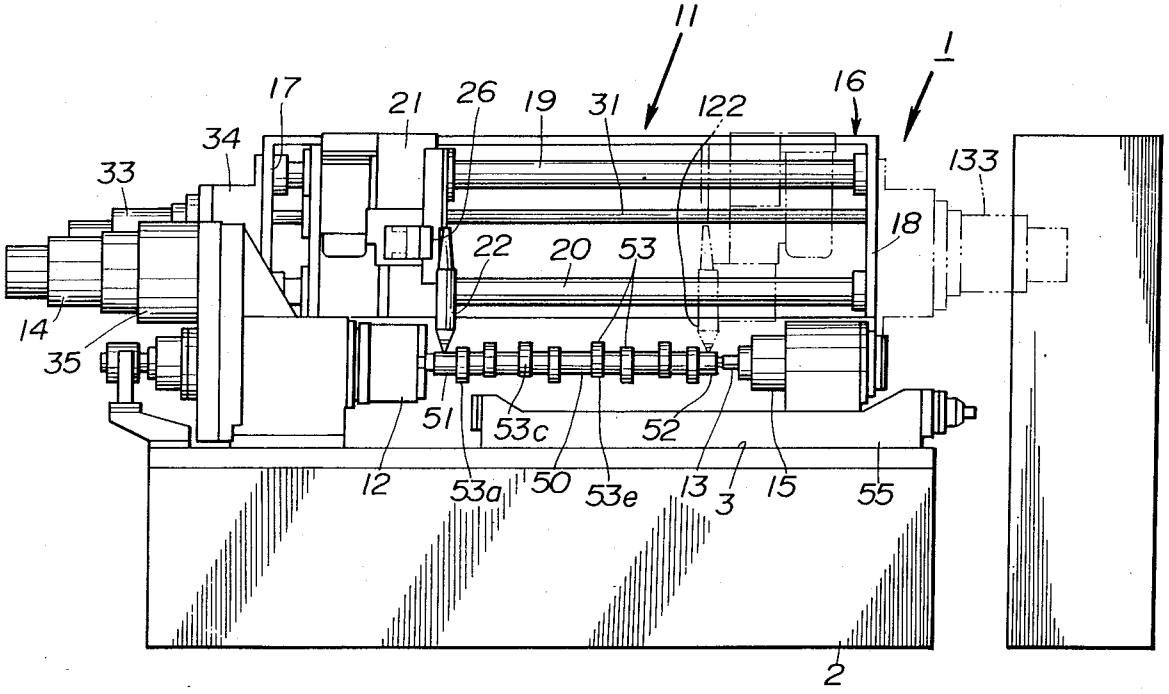
FIG. 1 is a front elevational view of a remelting and hardening apparatus according to a first embodiment of the present invention.
Figure 2:
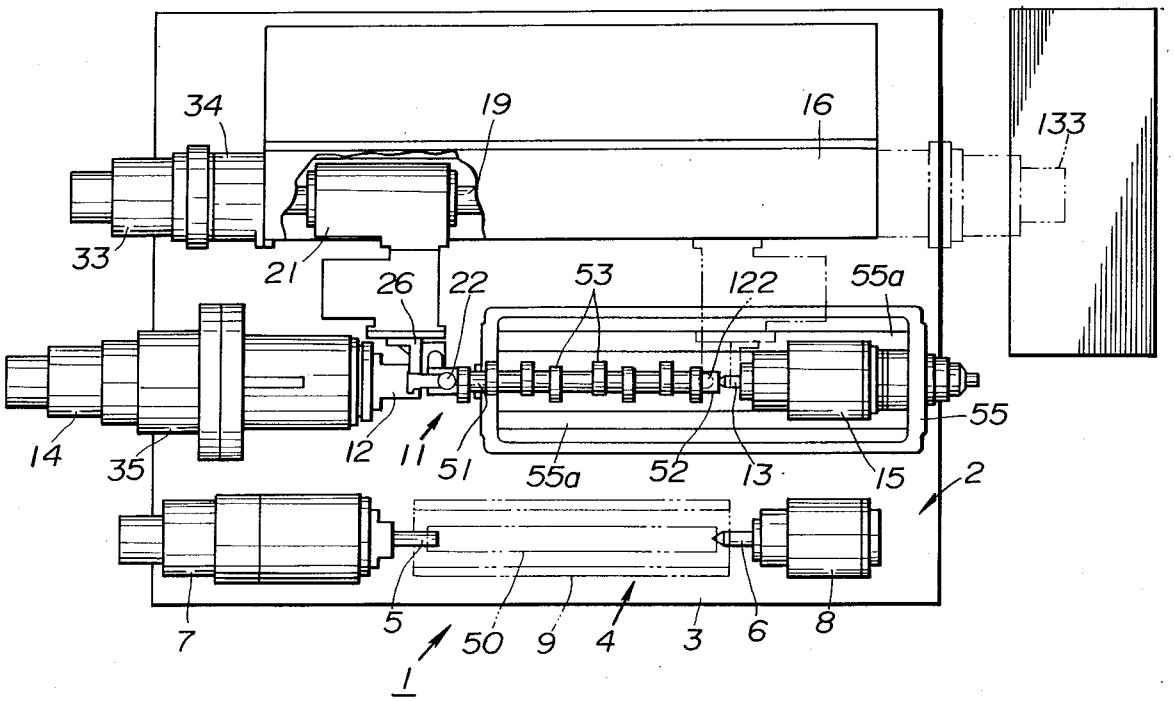
FIG. 2 is a plan view of the apparatus shown in FIG. 1.
Figure 3:
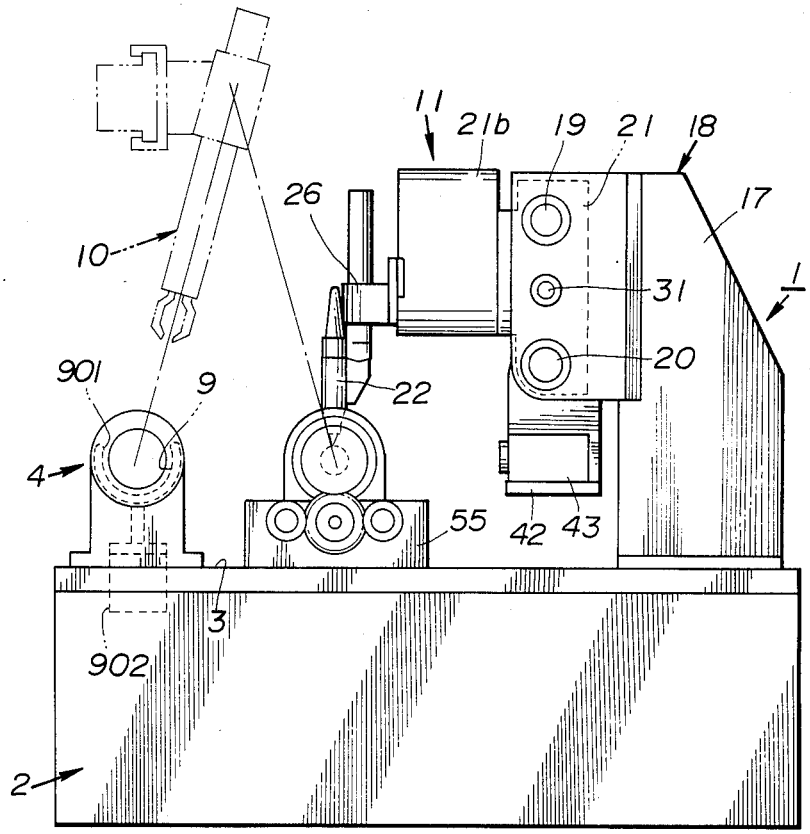
FIG. 3 is a side elevational view of the apparatus shown in FIG. 1.

As shown in FIGS. 1 through 3, a remelting and hardening apparatus 1 has a machine base 2 including an upper table 3 on which a preheating mechanism 4, FIGS. 2 and 3, is mounted at a front side thereof. The preheating mechanism 4 is omitted from illustration in FIG. 1 for the sake of brevity.

The preheating mechanism 4 has a workpiece chuck 5 and a center 6 for supporting the ends of a workpiece or camshaft 50 lying horizontally. The workpiece chuck 5 is coupled to a workpiece rotating motor 7, and the center 6 is coupled to an axial displacement fluid cylinder 8. Between the workpiece chuck 5 and the center 6, there is disposed a high-frequency heating coil 9 having an upwardly opening configuration of a semicircular cross section and elongated in the axial direction. The high-frequency heating coil 9 constitutes a preheating station in a foremost position on the table 3. The camshaft 50 to be treated extends through the high-frequency heating coil 9 of the preheating mechanism 4 and has its axially opposite ends supported respectively by the workpiece chuck 5 and the center 6.

As illustrated in FIG. 3, the camshaft 50 can be vertically taken into and out of the coil 9 through an upper recess or opening 901 extending the full length of the coil 9. The camshaft 50 can therefore be inserted into the coil 9 through the recess 901. In the illustrated embodiment, the coil 9 can be brought toward and away from the cam shaft 50 supported between the workpiece chuck 5 and the center 6 by means of a cylinder unit 902 coupled to the coil 9 and mounted on the machine base 2 beneath the coil 9. In operation, the motor 7 is energized to rotate the camshaft 50 about its own axis, and the coil 9 is also energized to preheat the camshaft 50 by currents induced by a high-frequency magnetic flux produced by the coil 9. The preheated camshaft 50 is then gripped by a loader 10 (FIG. 3) inserted downwardly into the coil 9 through the recess 901. The loader 10 is then lifted to remove the preheated camshaft 50 out of the coil 9 and moved back to transfer the preheated camshaft 50 to a processing station 11 behind the preheating mechanism 4.

As described above, the camshaft 50 is preheated in preparation for a remelting process by the preheating mechanism 4 positioned in front of the processing mechanism 11. After the camshaft 50 has been preheated, it is elevated by the loader 10 and quickly transferred back to the processing mechanism 11 in which the cam shaft 50 is oriented in the same direction as the direction in which it has been preheated in the preheating mechanism 4. Consequently, the camshaft 50 can easily and quickly be transferred from the preheating mechanism 4 to the processing mechanism 11. Since the camshaft 50 is translated from the preheating mechanism 4 to the processing mechanism 11 without any change in its posture, the preheating mechanism 4 and the processing mechanism 11 may be spaced as small a distance as possible from each other. Therefore, the camshaft 50 can be preheated and remelted on the same apparatus, which takes up a minimum space of installation, is compact in size, and allows successive camshafts to be simultaneously preheated and remelted repeatedly for achieving effiecient and quick remelting cycles.

While in the present embodiment the preheating mechanism 4 is described as comprising a high-frequency heating device, it may comprise an electric heating device providing the preheating mechanism 4 is positioned close enough to the processing mechanism 11, as illustrated, for the preheated camshaft 50 to be able to be transferred to the processing mechanism 11 before the preheated camshaft 50 is subjected to a substantial temperature reduction. Where the electric heating device is employed, the next remelting process may be carried out in a constant time cycle, and a next camshaft may be preheated in timed relation to the remelting process. Thus, the preheating mechanism 4 and the processing mechanism 11 can be operated highly efficiently in coaction with each other.

The processing mechanism 11 serves as a remelting and hardening station. The processing mechanism 11 is also composed of a workpiece chuck 12 for supporting one end of the camshaft 50, a motor 14 operatively coupled to the workpiece chuck 12 through a speed reducer 35, a center 13 for supporting the other end of the camshaft 50, and an axial displacement fluid cylinder 15 for axially moving the center 13. The fluid cylinder 15 is guided by guide bars 55*a*, 55*a* supported on a support frame 55 mounted on the table 3 so as to move to the left (FIGS. 1 and 2).

A substantially inverted U-shaped support frame 16 is mounted on the table 3 at a rear portion thereof and spaced obliquely upwardly from the cam shaft 50 supported by the chuck 12 and the center 5. As shown in FIG. 1, the support frame 16 is composed of a pair of spaced vertical frame members 17, 18 between which vertically spaced guide bars 19, 20 extending horizontally are supported. The guide bars 19, 20 extend through upper and lower portions of a base 21 of a plasma torch 22 for remelting and hardening the camshaft 50, and the plasma torch 22 can be moved horizontally on and along the guide bar 19, 20. A feed screw 31 is rotatably disposed horizontally between the guide bars 19, 20 and held in threaded engagement with the base 21. The feed screw 31 is coupled through a transmission mechanism 34 to a torch motor 33 disposed outwardly of the lefthand vertical frame member 17 as shown in FIG. 1. The feed screw 31 can be rotated by the motor 33 selectively in opposite directions about its own axis.

Figure 4:
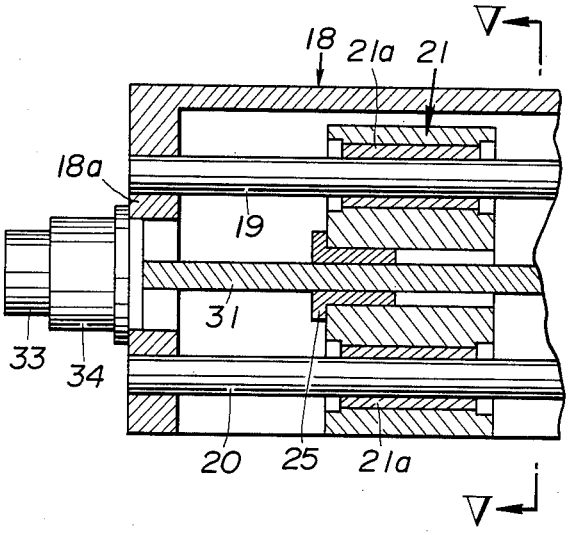
FIG. 4 is a fragmentary sectional front elevational view of a feed screw and a base held in mutually threaded engagement.
Figure 5:
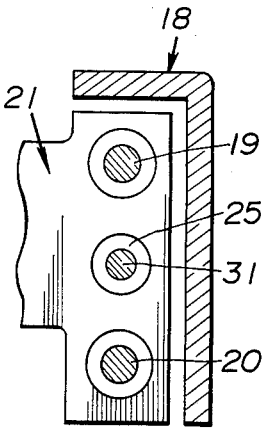
FIG. 5 is a cross-sectional view taken along line V—V of FIG. 4.

FIGS. 4 and 5 show in detail the interengaging relationship between the base 21, the guide bars 19, 20, and the feed screw 31. The guide bars 19, 20 extend through bearings 21*a*, 21*a* mounted in the base 21. The feed screw 31 is threaded in a nut 25 fixedly mounted on the base 21 through a ball nut mechanism (not shown).

A motor 21*b* is mounted on the base 21 (FIG. 3) for vertically moving a holder 26 by which the plasma torch 22 is supported. The plasma torch 22 supported by the holder 26 has a tip end directed downwardly with its vertical axis positioned upwardly of and directed toward the camshaft 50 supported between the chuck 12 and the center 13.

Figure 6:
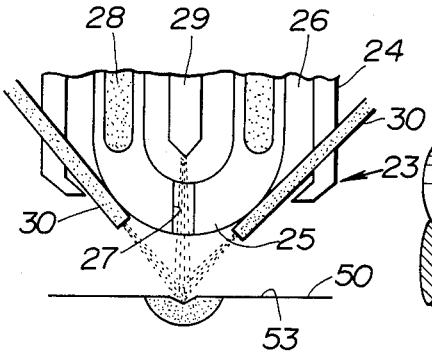
FIG. 6 is an enlarged vertical cross-sectional view of a plasma torch nozzle.
Figure 8:
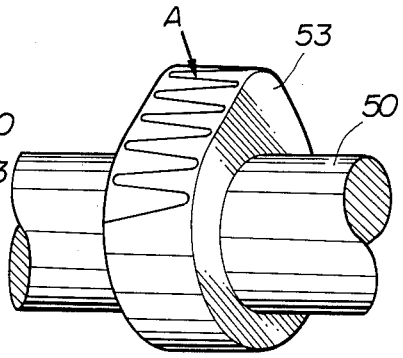
FIG. 8 is a perspective view showing a path of processing movement of a torch over the cam surface of a cam.

As illustrated in FIG. 6, the plasma torch 22 includes a nozzle 23 at its tip end, having a tip 25 disposed in a shield cap 24 with a passage 26 defined between the tip 25 and the shield cap 24 for allowing passage of an inert gas therethrough. The tip 25 has a central passage 27 for passage of a working gas such as an argon gas, and a cooling passage 28 defined around the central passage 27. An electrode 29 as of tungsten is disposed in the passage 27. A pair of metal powder supply tubes 30, 30 is inserted through the shield cap 24, with their axes crossing the axis of the passage 27. An electric discharge produced by the electrode 29 of the nozzle 23 and a plasma gas formed by the working gas generate a molten pool in an outer surface of each cam 53 of the camshaft 50, and metal powder is supplied from the metal powder supply tubes 30, 30 to the molten pool to perform the process of remelting and hardening the cam surface.

Figure 7:
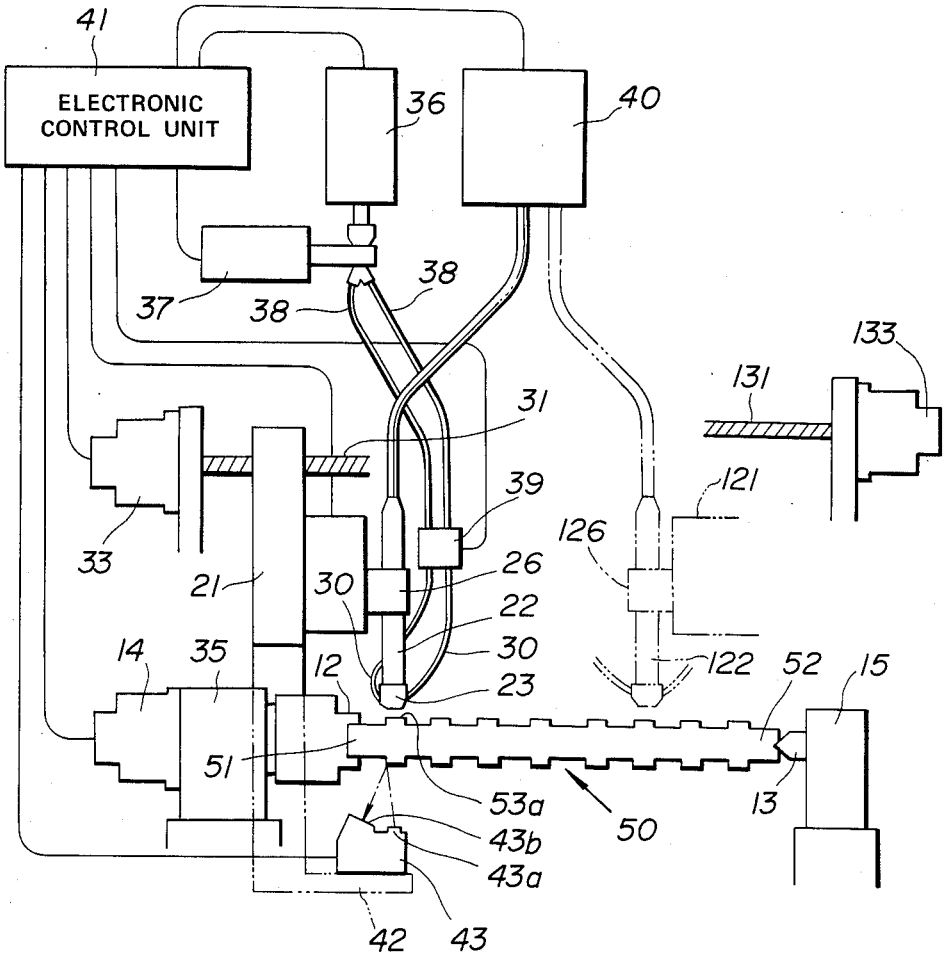
FIG. 7 is a diagrammatic view of a control system for the remelting and hardening apparatus.

As shown in FIG. 7, the electrode 29, FIG. 6, of the plasma torch 22 is supplied with a prescribed amount of electric power from a plasma power supply 40. A metal powder supply device 36, while being vibrated by a vibrator 37, supplies metal powder through tubes 38, 38 to the metal powder supply tubes 30, 30. The tubes 38, 38 pass through a detector 39 for detecting whether the metal powder is supplied therethrough or not.

An electronic control unit 41 comprises a computer programmed to apply operation control signals to the motor 14 for rotating the camshaft, the motor 33 for moving the torch 22 horizontally, and the motor 21*b* on the base 21 for moving the torch 22 vertically. The operation control signals are in the form of pulse signals, and hence the motors 14, 33, 21*b* comprise stepping motors. Alternatively, these motors may comprise servomotors controlled in feedback loops by position detectors such as encoders. The control unit 41 also applies drive signals to the plasma power supply 32, the metal powder supply device 33, and the vibrator 34.

As shown in FIG. 7, the base 21 has an integral attachment 42 extending downwardly and supporting a position sensor 43 for detecting the position of each cam 53. While the position sensor 43 is shown as positioned below the camshaft 50 for illustrative purpose, the position sensor 43 is actually disposed on the righthand side (FIG. 3) of the camshaft 50. The position sensor 43 may comprise an output unit or transmitter 43*a* for emitting light, magnetic flux, or ultrasonic energy, for example, and an input unit or receiver 43*b* for receiving the transmitted energy reflected from the camshaft 50 and issuing information related to the detected camshaft 50 to the control unit 41. Preferably, the position sensor 43 should comprise a laser beam position sensor.

A process of remelting and hardening the cams of the camshaft 50 will be described hereinbelow.

The camshaft 50 which has been preheated by the preheating mechanism 4 is transferred to and fixedly supported between the workpiece chuck 12 and the center 13. Then, the motor 33 is energized to rotate the feed screw 31 for thereby moving the base 21 horizontally along the feed screw 31, and at the same time the motor 21*b* is energized to move the holder 26 downwardly. The torch 22 is now brought from a standby position toward a position in which the nozzle 23 is spaced a clearance from the cam surface of a first cam 53*a* on the lefthand end (FIG. 7) of the camshaft 50.

As the base 21 starts moving to the right, the position sensor 43 mounted thereon is also moved to the right. The position sensor 43 facing the camshaft 50 emits a laser beam, for example, from the output unit 43*a* comprising a laser beam source, for example, toward the camshaft 50 and receives a reflected laser beam from the camshaft 50 with the receiver 43*b* comprising a camera, for example. When one edge or an end face of the cam surface of the cam 53*a* is detected by the position sensor 43, the position sensor 43 issues a signal to the control unit 41, which then stops the movement of the base 21. The position sensor 43 and the torch 22 are positioned in an offset relation so that the torch 22 can be fixed in a reference position in which to start the remelting and hardening process.

The torch 22 may be positioned in the reference position by detecting an opposite edge or end face of the cam surface of the cam 53*a*. In addition, the position and width of the cam on the camshaft 50 can accurately be detected by sensing both of the end faces of the cam.

Furthermore, the position in which to start the remelting and hardening process may be established by detecting either end face of the cam and thereafter moving the base 21 from the detected position serving as a reference.

As the torch 22 is thus positioned, the cam surface of the first cam 53*a* of the camshaft 50 is remelted and hardened by the nozzle 23 in the manner described above with reference to FIG. 6. During this remelting and hardening process, the camshaft 50 is rotated about its own axis at a low speed by the motor 14 through the speed reducer 35, whereas the torch 22 is vertically moved by the motor 21*b* controlled by the control unit 41 to enable the tip end thereof to follow variations in height of the cam 53*a* with a constant clearance kept between the tip end of the torch 22 and the cam surface. At the same time, the torch 22 is horizontally moved reciprocally within the width of the cam surface by the motor 33 under the control of the control unit 41. The motor 33 is repeatedly rotated in one direction and reversed by pulse signals generated according to the program of the control unit 41. The time in which the motor 33 is rotated in one direction, and the time in which the motor 33 is reversed, are selected to be a time in which the tip end of the torch 22 traverses the width of the cam 53*a*. The rotation of the motor 33 in the opposite directions is transmitted through the ball nut mechanism between the feed screw 31 and the nut 25 to the base 21 of the torch 22, causing the base 21 to reciprocate smoothly in the horizontal direction while being guided by the guide bars 19, 20. The reciprocating movement of the torch 22, combined with the rotation of the camshaft 50, enables the torch 22 to remelt and harden the cam surface while at the same time following a meandering path A on the cam surface of the cam 53*a*.

Figure 9:
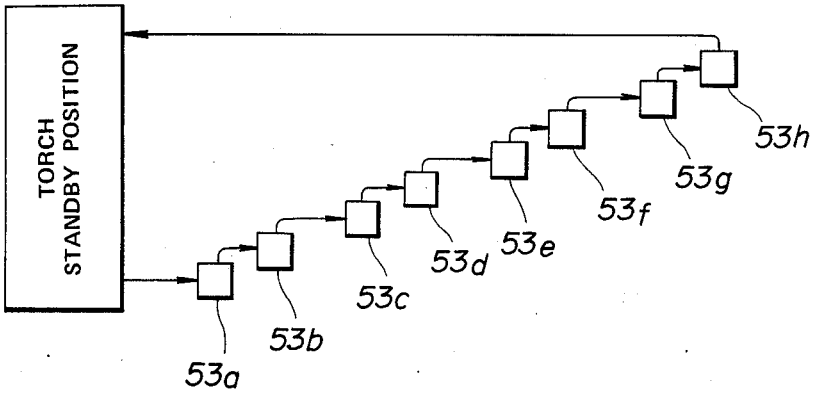
FIG. 9 is a diagram showing the manner in which a single torch is shifted.

When the cam 53*a* has been remelted and hardened, the base 21 starts to move to the right under a command from the control unit 41 until a next cam is reached. Then, the next cam is remelted and hardened in the same manner as described above. As shown in FIG. 9, all cams 53*a* through 53*h* are remelted and hardened successively with the torch 22, followed by moving the torch 22 back to the standby position in preparation for a next remelting and hardening process. The remelted and hardened camshaft 50 is replaced with a new unprocessed camshaft, which will then be remelted and hardened in the manner described above. A number of camshafts can successively be processed by repeating the above cycle of operation.

In the remelting and hardening process, the torch 22 can be moved horizontally by the motor 33 energized by pulse signals applied thereto by the control unit 41.

With the remelting and hardening apparatus 1 of the above construction, a plurality of cams can be remelted and hardened by the single torch 22, and hence the apparatus 1 is relatively simple and small in size. Even where the cams are spaced at small pitches, they can smoothly be processed successively by moving the torch in increments in the axial direction. Since the cams are processed successively by rotating the camshaft about its own axis and moving the torch into successie positions facing the cams, the camshaft can be treated on the same apparatus without removal or interruption until the process is over.

In the above embodiment, the torch 22 is reciprocally moved to follow the meandering path over each of the cams as they rotate. Instead, the torch may be moved only vertically while being held immovable in the axial direction, and the camshaft may be reciprocally moved axially for an interval equal to the axial length of each of the cams. With such a modification, however, a complex and large reciprocating mechanism is required to impart reciprocating motion to the motor 14 and the fluid cylinder 15. Therefore, the illustrated arrangement in which the torch is reciprocally moved by the rotation of the feed screw in the opposite directions is much better than the above alteration.

As shown in FIGS. 1, 2 and 7, another torch 122 may be provided in a righthand position in addition to the torch 22. The torch 122 is supported by a holder 126 mounted on a base 121. The base 121 is movably fitted over the guide bars 19, 20 and held in threaded engagement with a feed screw 131 rotatable by a motor 133. Thus, the torch 122 can be moved independently by the motor 133. The other construction of the torch 122 is the same as that of the torch 22. The torch 122 can be horizontally moved by the motor 133 and vertically moved by a motor in the base 121 under the control of the electronic control unit 41.

Figure 11:
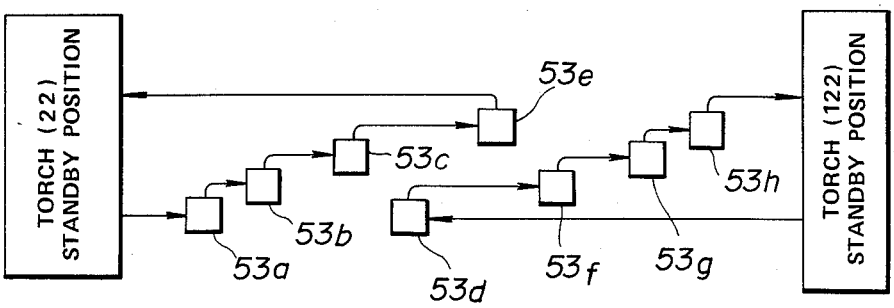
FIG. 11 is a diagram showing the manner in which two torches are shifted.
Figure 10:
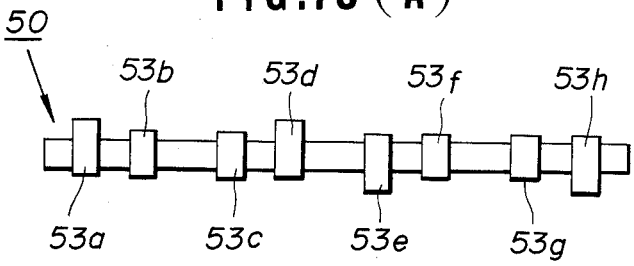
FIG. 10A is a side elevational view of a camshaft.
FIG. 10B is a diagram illustrative of top or highest positions of the cams, showing cam pairs substantially in phase.
Figure 10:
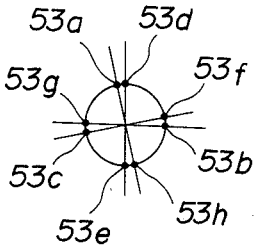

As illustrated in FIG. 10, the cams 53*a* through 53*h* of the camshaft 50 are grouped into pairs 53*a*, 53*d*; 53*b*, 53*f*; 53*c*, 53*g*; and 53*e*, 53*h* each composed of cams angularly positioned substantially in phase. The cams in each pair are axially spaced a sufficient distance from each other. The cams 53*a*, 53*b*, 53*c*, 53*e* are processed by the torch 22, which the cams 53*d*, 53*f*, 53*g*, 53*h* are processed by the torch 122. The torches 22, 122 are moved simultaneously to remelt and harden the cam surfaces of the cams in each pair, as illustrated in FIG. 11.

With such an arrangement, the torches 22, 122 operate out of interference with each other, and the time required to process all of the cams with the two torches 22, 122 is half the time required for the single torch 22 to process all of the cams since each of the two torches 22, 122 processes half of the camshaft 50. In the illustrated embodiment, the pairs of cams which are of the same cam profile and angularly positioned substantially at the same angle are processed successively by the torches 22, 122. Thus, the cam pairs can be processed under the control of the same program, with the result that the control unit may be simplified.

By moving the two torches in paths parallel to each other axially along the camshaft, the camshaft can be processed in a reduced period of time with an increased degree of efficiency. The apparatus employing the two torches is suitable for processing camshafts for use in multicylinder engines, having many cams such as eight cams and twelve cams.

Figure 12:
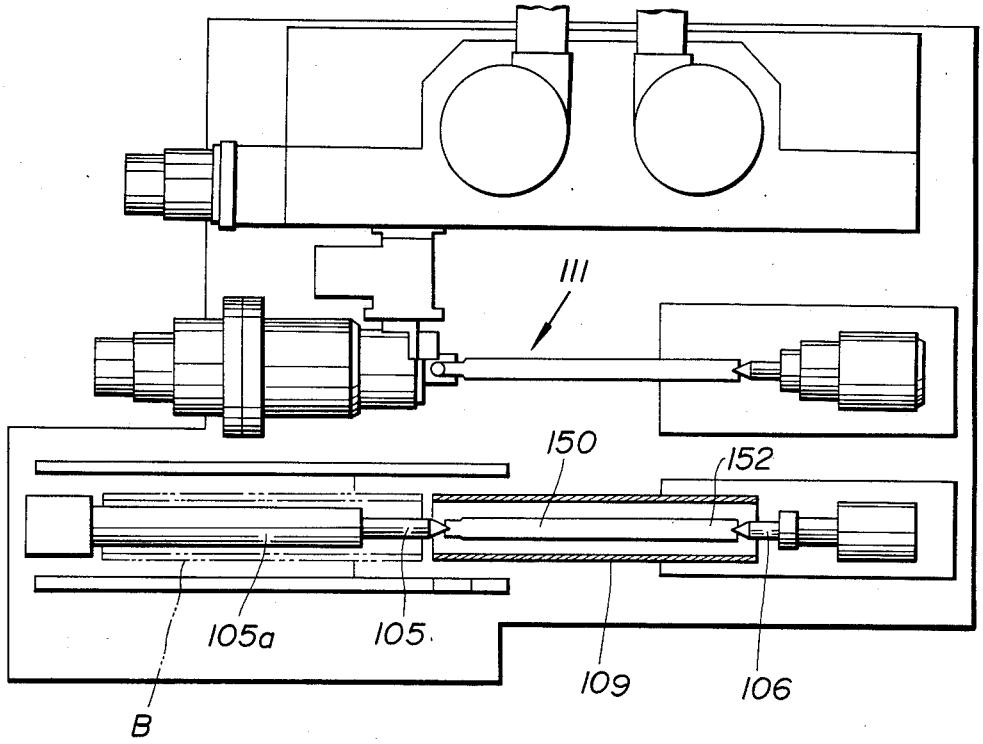
FIG. 12 is plan view of of a remelting and hardening apparatus according to a second embodiment of the present invention.
Figure 13:
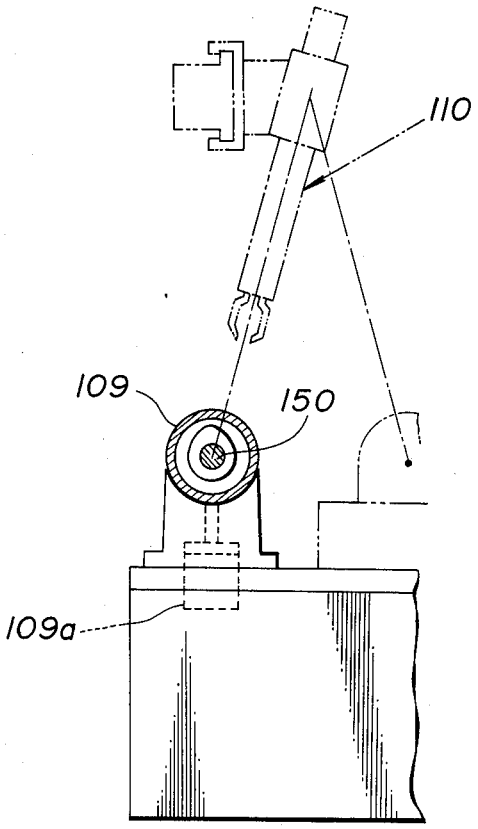
FIG. 13 is a fragmentary sectional side elevational view of the apparatus of FIG. 12.

FIGS. 12 and 13 show an apparatus according to a second embodiment of the present invention. A preheating mechanism 104 disposed in front of a processing mechanism 111 comprises a tubular coil 109. A camshaft 150 has an end 152 supported by a center 106 and an opposite end supported by a chuck 105. The chuck 105 has a shank 105*a* which is of substantially the same axial length as that of the coil 109, while the axial length of the coil 109 is slightly longer than the camshaft 150. The coil 109 is movable toward and away from the chuck 105 by a holder 109*a*, FIG. 13, disposed below the coil 109. The coil 109 surrounds the camshaft 150 supported between the chuck 105 and the center 106 over the entire length of the camshaft 150 for heating the camshaft 150 with currents induced by magnetic flux produced by the coil 109. After the camshaft 150 has been preheated the coil 109 is moved toward the chuck 105 as indicated by the two-dot-and-dash lines in FIG. 12 away from the camshaft 150 into surrounding relation to the shank 105*a*. Then, the preheated camshaft 150 is transferred by a loader 110 to the processing mechanism 111. A next camshaft is then supported between the chuck 105 and the center 106, and the coil 109 is axially moved into surrounding relation to the new camshaft 150 to preheat the same. The above cycle of operation is repeated to process a succession of camshafts.

The apparatus of the present invention can process not only camshafts, but also other shafts or elongate members.

With the arrangement of the present invention, a workpiece such as a camshaft having a plurality of surfaces or portions to be remelted and hardened can be processed highly efficiently and effectively by a single apparatus having at least one torch, and hence the apparatus itself is relatively simple in construction.

Since the apparatus includes a preheating mechanism located so closely to a processing mechanism that the workpiece can be translated from the preheating mechanism to the processing mechanism, the overall apparatus is compact in size, takes up a relatively small space for installation, and can be manufactured inexpensively. The workpiece to be processed can easily and quickly be transferred from the preheating mechanism to the processing mechanism. As a consequence, the preheated workpiece is prevented from being cooled before it reaches the processing mechanism, and is kept at a stable preheated temperature when the workpiece is remelted and hardened, with the result that the remelted and hardened workpiece is uniform in quality. As other advantages, the workpiece can be processed in a reduced period of time with a high degree of efficiency. A temperature to which the workpiece is to be preheated can freely be selected without concern over any temperature reduction prior to the remelting and hardening process. The apparatus of the invention therefore provides an improved thermal efficiency in the remelting and hardening process.

Although there have been described what are at present considered to be the preferred embodiments of the present invention, it will be understood that the invention may be embodied in other specific forms without departing from the spirit or essential characteristics thereof. The present embodiments are therefore to be considered in all aspects as illustrative, and not restrictive. The scope of the invention is indicated by the appended claims rather than by the foregoing description.

What is claimed is:

1. A method for remelting and hardening elongate workpieces each having a plurality of axially spaced portions to be processed, said method comprising the steps of:

(a) holding one workpiece in a first position;
(b) rotating said workpiece about its own axis in said first position;
(c) heating said rotating workpiece held in said first position;
(d) thereafter, quickly transferring said heated workpiece to a second position close and parallel to said first position before said workpiece is subjected to a substantial temperature reduction;
(e) holding said workpiece in said second position;
(f) rotating said workpiece about its own axis in said second position;
(g) remelting and hardening at least a portion of the outer surface of at least one of said portions to be processed with torch means positioned at said at least one of said portions to be processed;
(h) after said at least one of said portions has been remelted and hardened moving said torch means axially along said rotating workpiece;
(i) detecting the next of said predetermined portions to be processed;
(j) stopping said torch means at said detected next portion, remelting and hardening at least a portion of the outer surface at said detected next portion;
(k) continuing said axially moving, detecting and stopping of said torch means along said wortkpiece and remelting and hardening of said portions;
(l) after all of said spaced portions to be processed have been remelted and hardened detaching said workpiece from said second position;
(m) starting said step (a) with respect to the next workpiece in timed relation of a time cycle of remelting and hardening of the portions to be processed of said one workpiece; and
(n) repeating said steps (a) to (m) until all of the elongate workpieces have been processed.

2. A method according to claim 1, wherein said portions are remelted and hardened by reciprocally moving said torch means axially along said workpiece within the width of the outer surfaces of said portions, whereby torch means follows a meandering path over the outer surface of each of said portions during said remelting and hardening.

3. A method according to claim 1, wherein said portions are grouped into pairs each composed of portions angularly positioned substantially in phase with each other, said portions in each pair being remelted and hardened two torches, respectively.

4. A method according to claim 1, wherein each of said portions starts being remelted and hardened when at least one axial end of the workpiece portion is sensed by a sensor movable with said torch axially along said workpiece.

5. An apparatus for remelting and hardening an elongate workpiece having a plurality of axially spaced portions to be processed, said apparatus comprising:

(a) first holding means for holding said workpiece in a first position;
(b) first workpiece rotating means for rotating said workpiece about its own axis in said first position;
(c) preheating means for heating said workpiece held by said first holding means;
(d) transferring means for quickly transferring said heated workpiece to a second position close and parallel to said first position before said workpiece is subjected to a substantial temperature reduction;
(e) second holding means for holding said workpiece in said second position;
(f) second workpiece rotating means for rotating said workpiece about its own axis in said second position;
(g) at least one torch for remelting and hardening portions of the outer surfaces of said workpiece;
(h) torch moving means for moving said torch axially along said workpiece from position to position into facing relations to the outer surfaces of each of said portions to be remelted and hardened;
(i) detecting means movable with said torch axially along said workpiece for detecting each of said portions to be remelted and hardened, said torch moving means comprising means for stopping the movement of said torch axially along said workpiece at a position which faces the outer surface of said detected portion and for starting the remelting and hardening of said outer surface, when at least one axial end of said portion is detected by said detecting means; and
(j) electronic control means for supplying control signals to said torch moving means to control the oepration of said torch moving means.

6. An apparatus according to claim 5, including two torches for remelting and hardening at least a portion of the outer surfaces of said portions, said torch moving means comprising two torch moving units coupled respectively to said two torches for independently moving said torches, said portions being grouped into pairs each composed of portions angularly positioned substantially in phase with each other, said two torch moving units being controlled by said electronic control means to bring said torches into facing relation to said portions, respectively, in each pair.

7. An apparatus according to claim 5, wherein said torch moving means includes means for reicprocally moving said torch axially along said workpieces within the width of the outer surface of said portion, while said torch is remelting and hardening the outer surface of said portions.

8. An apparatus according to claim 7, wherein said reciprocally moving means comprises a stepping motor rotatable in one direction and the other in response to pulse signals applied thereto.

9. An apparatus according to claim 8, including electronic control means for generating said pulse signals to control said stepping motor.

10. An apparatus according to claim 5, wherein said preheating means comprises a high-frequency heating device including a heating coil having an upwardly opening configuration of an arcuate cross section, said heating coil having substantially the same length as that of said workpiece.

11. An apparatus according to claim 5, wherein said preheating means comprises a high-frequency heating device including a tubular heating coil, said heating coil having substantially the same length as that of said workpiece and movable axially along said workpiece.

12. An apparatus according to claim 5, wherein said preheating means comprises an electric heating device.

* * * * *